US010865639B1

(12) United States Patent
Bishop et al.

(10) Patent No.: US 10,865,639 B1
(45) Date of Patent: Dec. 15, 2020

(54) DOWNHOLE ACOUSTIC TRANSDUCER DELIVERY SYSTEM

(71) Applicants: David Bishop, Cypress, TX (US); Robert O'Brien, Katy, TX (US)

(72) Inventors: David Bishop, Cypress, TX (US); Robert O'Brien, Katy, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 0 days.

(21) Appl. No.: 16/539,792

(22) Filed: Aug. 13, 2019

(51) Int. Cl.
*E21B 47/16* (2006.01)
*E21B 41/00* (2006.01)
*E21B 47/06* (2012.01)

(52) U.S. Cl.
CPC ..... *E21B 47/16* (2013.01); *E21B 41/00* (2013.01); *E21B 47/06* (2013.01)

(58) Field of Classification Search
CPC ..... E21B 47/16; E21B 41/00; E21B 47/06
See application file for complete search history.

(56) References Cited

U.S. PATENT DOCUMENTS 4,736,204 A * 4/1988 Davison ..... E21B 47/124 175/40
4,928,088 A * 5/1990 Jorion ..... E21B 47/122 175/40
5,639,135 A * 6/1997 Beeman ..... E21B 31/18 294/86.15
6,442,105 B1 8/2002 Tubel et al.
2004/0129424 A1* 7/2004 Hosie ..... E21B 21/08 166/332.8
2015/0226017 A1* 8/2015 Telfer ..... E21B 37/00 175/57

* cited by examiner

*Primary Examiner* — Amine Benlagsir
(74) *Attorney, Agent, or Firm* — Cantor Colburn LLP

(57) ABSTRACT

An apparatus for transmitting and/or receiving energy in a borehole penetrating a subsurface formation includes a tubular assembly having a tubing mandrel and a sleeve at least partially surrounding a circumference of the tubing mandrel, wherein the tubing mandrel includes a cavity and the sleeve defines at least a portion of an opening over the cavity. The apparatus also includes a transducer assembly disposed in the cavity and configured for transmitting and/or receiving the energy, wherein the transducer assembly upon relative movement of the tubing mandrel with respect to the sleeve is displaced radially.

19 Claims, 4 Drawing Sheets

DOWNHOLE ACOUSTIC TRANSDUCER DELIVERY SYSTEM

BACKGROUND

Hydrocarbon production typically requires boreholes drilled into the earth to access reservoirs of the hydrocarbons. Completion operations are then performed and usually include installing casings lining the boreholes. It would be advantageous to know a property such as pressure in an annulus between the casing and the earth in order to make decisions to enable efficient and productive completion operations going forward. Hence, it would be well received in the hydrocarbon production industry if sensor systems for sensing values of a property in the annulus and transmitting the sensed property values to the surface were developed.

BRIEF SUMMARY

Disclosed is an apparatus for transmitting and/or receiving energy in a borehole penetrating a subsurface formation. The apparatus includes: a tubular assembly having a tubing mandrel and a sleeve at least partially surrounding a circumference of the tubing mandrel, wherein the tubing mandrel includes a cavity and the sleeve defines at least a portion of an opening over the cavity; and a transducer assembly disposed in the cavity and configured for transmitting and/or receiving the energy, wherein the transducer assembly upon relative movement of the tubing mandrel with respect to the sleeve is displaced radially.

Also disclosed is a method for transmitting and/or receiving energy in a borehole penetrating a subsurface formation. The method includes: conveying a tubular assembly through the borehole, the tubular assembly having a tubing mandrel and a sleeve at least partially surrounding a circumference of the tubing mandrel, wherein the tubing mandrel includes a cavity and the sleeve defines at least a portion of an opening over the cavity, wherein a transducer assembly is disposed in the cavity and configured for transmitting and/or receiving the energy, and wherein the transducer assembly upon relative movement of the tubing mandrel with respect to the sleeve is displaced radially; stopping conveyance of the sleeve in the borehole at a selected location while the tubing mandrel proceeds downhole; displacing the transducer assembly radially through the opening due to relative movement of the tubing mandrel with respect to the sleeve; and transmitting and/or receiving energy using the displaced transducer assembly.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the figures.

Disclosed are embodiments of apparatuses and methods for sensing a value of a property in an annulus exterior to a casing lining a borehole penetrating the earth. The apparatuses and methods involve using a fixed exterior sensor and a fixed exterior acoustic transducer that are disposed in the annulus with the fixed exterior acoustic transducer being in acoustic communication with the outside surface of the casing. A conveyable acoustic transducer assembly is disposed in a cavity of a tubing mandrel of an acoustic tool that is in a downhole tubular assembly. A sleeve surrounds the tubing mandrel and has an opening or gap through which conveyable acoustic transducer can extend to make contact with the casing and thus be in acoustic communication with the fixed exterior acoustic transducer. A locating collet is in mechanical communication with the sleeve. The locating collet engages a groove in the interior of the casing as the downhole tubular assembly is being conveyed in the borehole and locks the sleeve in place at a location that enables the acoustic transducer assembly to be close enough to have acoustic communication with the fixed exterior acoustic transducer. As the sleeve is locked in place, the conveyable acoustic transducer assembly extends mechanically from the cavity and is urged against the casing at the location close to the fixed exterior acoustic transducer in order to transmit and receive acoustic energy to and from the fixed exterior acoustic transducer. The acoustic energy transmitted to the fixed exterior acoustic transducer is used to power both the fixed exterior sensor and the fixed exterior acoustic transducer. The acoustic energy received from the fixed exterior acoustic transducer is used to operate the fixed exterior sensor and acoustic transducer.

Figure 1:
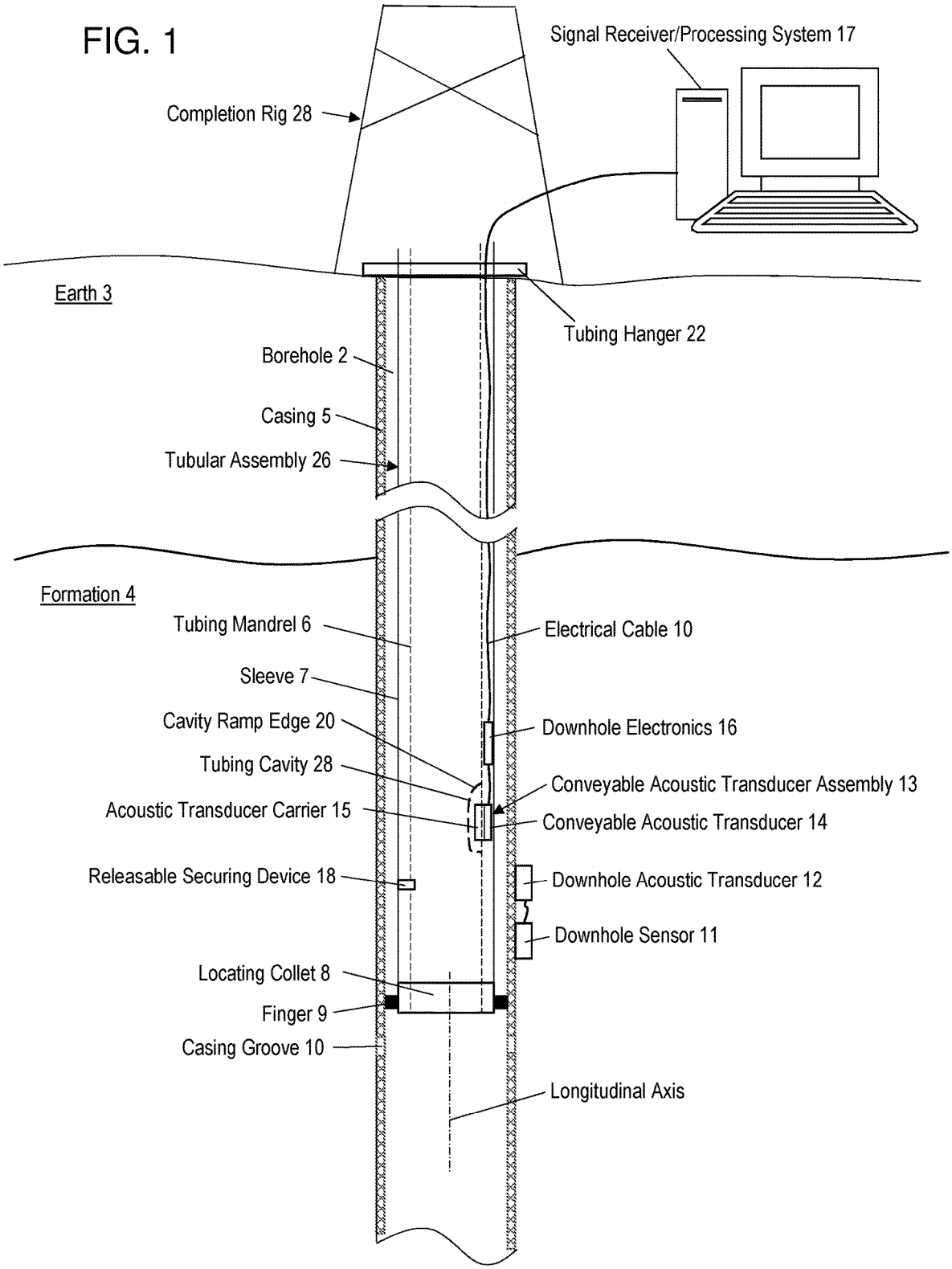
FIG. 1 is a cross-sectional view of an embodiment of a tubular assembly having an acoustic tool disposed in a borehole penetrating the earth with the acoustic tool being in a conveyable state.

FIG. 1 is a cross-sectional view of an embodiment of a tubular assembly 26 disposed in a borehole 2 penetrating the earth 3 having a subsurface formation 4. The subsurface formation 4 may include a reservoir of hydrocarbons that are being or will be produced. The borehole 2 can be vertical, deviated from the vertical such as horizontal, and/or include one or more lateral borehole extensions from the borehole 2. A casing 5 lines the borehole 2. Exterior to the casing 5 is an exterior acoustic transducer 12 and a sensor 11 at a fixed location. The sensor 11 is in electrical communication with the acoustic transducer 12 such that the sensor 11 can be powered by the transducer 12 and can send measurement data to the transducer 12 for being acoustically transmitted across the casing 5. In one or more non-limiting embodiments, the sensor 11 is configured to sense pressure and/or temperature. The term "transducer" relates to a device that can transform one form of energy into another form of energy. For example, an acoustic transducer can transform electrical energy into acoustic energy for transmission and/or receive acoustic energy and transform that energy into electrical energy.

The tubular assembly 26 includes a tubing mandrel 6 and a sleeve 7 that circumferentially surrounds at least a portion of the tubing mandrel 6. The sleeve 7 is temporarily secured to the tubing mandrel 6 by a releasable securing device 18. In one or more embodiments, the releasable securing device 18 is a shear screw that shears when a static weight of the tubing mandrel 6 and a dynamic load of the tubing mandrel 6 together exceeds a load threshold. In one or more embodiments, the shear screw has a diameter at a point that shears such that the screw at that diameter will shear when the load threshold is exceeded. Another embodiment of the releasable securing device 18 is a spring-loaded latch where the spring is calibrated to enable the latch to release when the load threshold is exceeded.

A conveyable acoustic transducer assembly 13 is disposed in a tubing cavity 28 in the tubing mandrel 6. The conveyable transducer assembly 13 includes an acoustic transducer carrier 15 and a conveyable acoustic transducer 14 disposed on the carrier 15. The tubing cavity 28 has a ramp edge 20 on the uphole side of the cavity 28 to aid in mechanically extending the carrier 15 and thus the transducer assembly 13 out of the tubing cavity 28.

Figure 2:
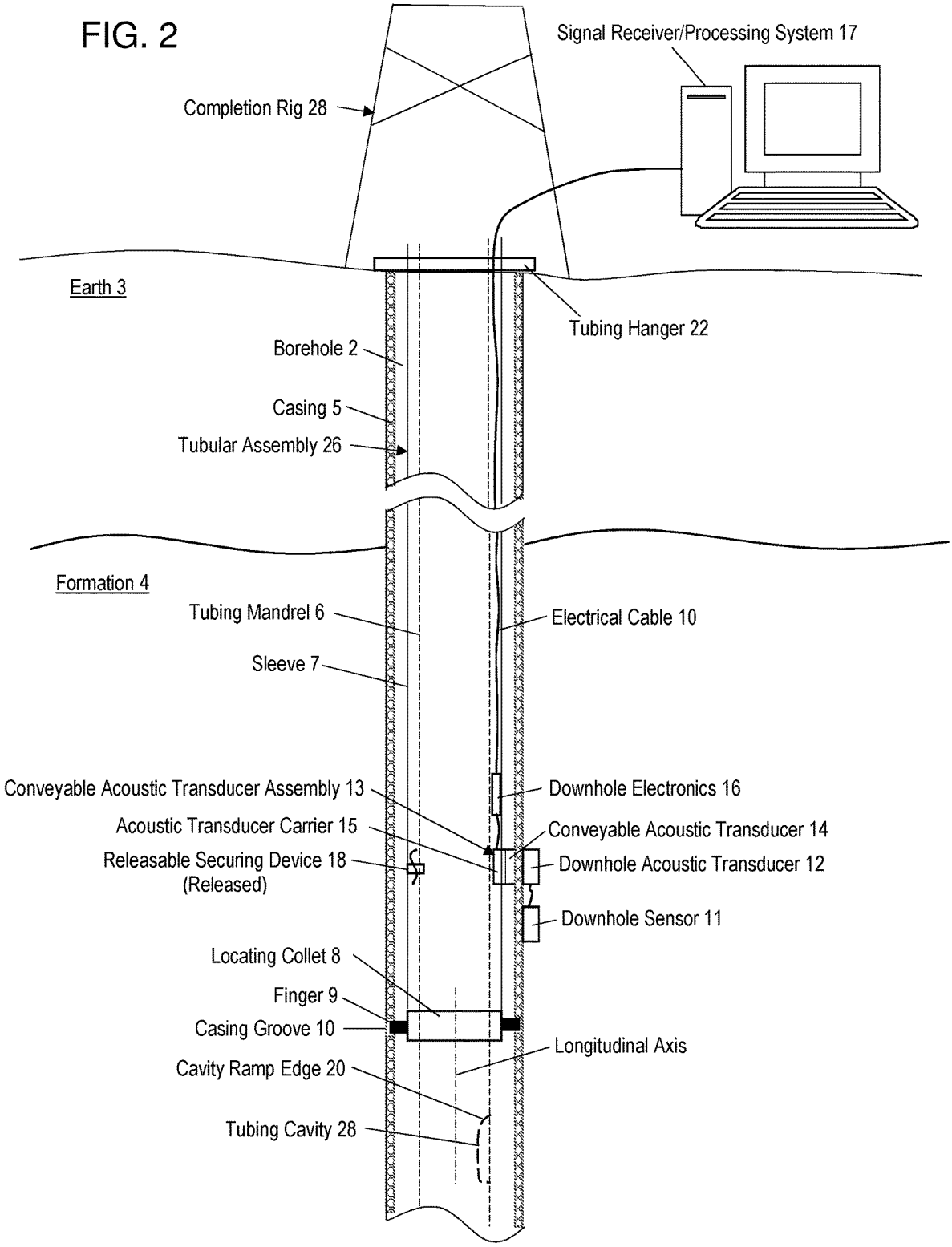
FIG. 2 depict aspects of the acoustic tool in an actuated state for communicating acoustic energy with an acoustic transducer disposed behind a casing lining the borehole.

A locating collet 8 is attached to the sleeve 7. The locating collet 8 includes one or more fingers 9 that are urged in an outward direction such as by use of a spring or spring-like device. The one or more fingers 9 are configured to interlock with a groove 10 in the casing 5. Hence, as the tubing assembly 26 is being lowered into the borehole 2, the locating collet 8 locks into the groove 10 and stops progression of the sleeve 7 (i.e., the sleeve 7 is locked in place). When the progression of the sleeve 7 stops, the releasable securing device 18 will release due to the static and dynamic loads impressed on the releasable securing device 18. Hence, although progression of the sleeve 7 further into the borehole 2 stops, the tubing mandrel 6 still proceeds further into the borehole 2 until a tubing hanger 22 stops progression of the tubing mandrel 6 by engaging the tubing mandrel 6 at a selected location. The relative motion of the tubing mandrel 6 proceeding into the borehole 2 axially with respect to the sleeve 7 being stopped causes the conveyable acoustic transducer assembly 13 to extend or be displaced from the tubing cavity 28 and make contact with the casing 5. In particular, the ramp edge 20 of the tubing cavity causes the carrier 15 to slide up on and over the ramp edge 20 and to sit on an outer surface of the tubing mandrel 6 as illustrated in FIG. 2.

Once the conveyable acoustic transducer 14 makes contact with the casing 5, acoustic energy can be transmitted to the exterior acoustic transducer 12. This energy can then be used to charge a battery for operation of the sensor 11. Also, the exterior acoustic transducer 12 can transmit acoustic energy having an acoustic signal to the conveyable acoustic transducer 14. The acoustic signal can include measurement data sensed by the sensor 11. The measurement data can be transmitted to a surface receiver and/or surface processing system 17 using downhole electronics 16 and an electrical cable 10. In one or more embodiments, the downhole electronics 16 are disposed in a chamber in an annulus between the tubing mandrel 6 and the sleeve 7 and the electrical cable 10 is tubing encapsulated cable (TEC). The surface receiver and/or surface processing system 17 is configured to receive the signal from the downhole electronics 16, process the signal to obtain the measurement data, and record and/or present the measurement data to a user such as by a display or a printer.

Figure 3:
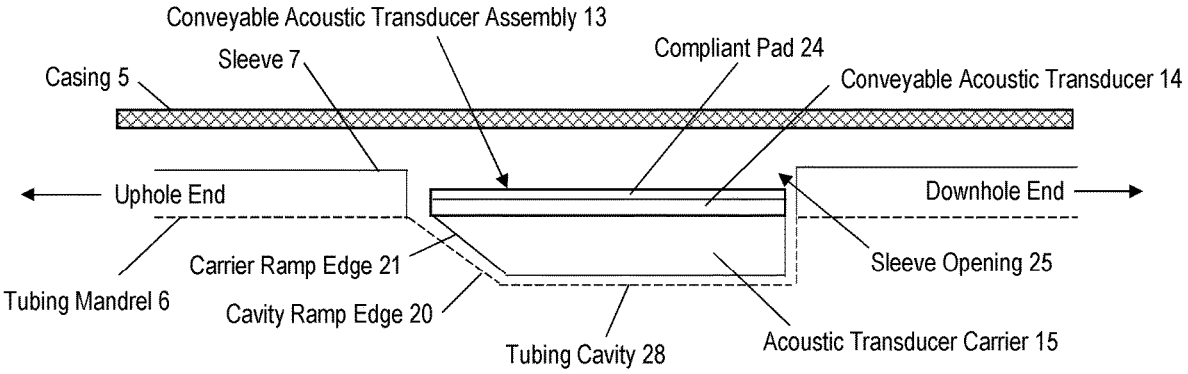
FIG. 3 depicts further aspects of the acoustic tool in the conveyable state.

FIG. 3 depicts further aspects of the conveyable acoustic transducer assembly 13 in the conveyable state. In the embodiment of FIG. 3, the acoustic transducer carrier 15 has a carrier ramp edge 21 on the uphole side of the carrier 15. Hence, the carrier 15 and/or the cavity 28 can have a ramp edge on the uphole end in order for the conveyable acoustic transducer assembly 13 to extend from the cavity 28 based on the relative motion of the tubing mandrel 6 with respect to the sleeve 7. The transducer assembly 13 extends through an opening 25 in the sleeve 7 that is over the cavity 28. As illustrated in FIG. 3, a compliant pad 24 is disposed on the conveyable acoustic transducer 14 in order to seat the transducer 14 firmly against the casing 5 so as to remove any air gaps or gas gaps between the transducer 14 and the casing 5. In one or more embodiments, the compliant pad 24 is made of a pliable material that can withstand high downhole temperatures such as a rubber or elastomer.

Figure 4:
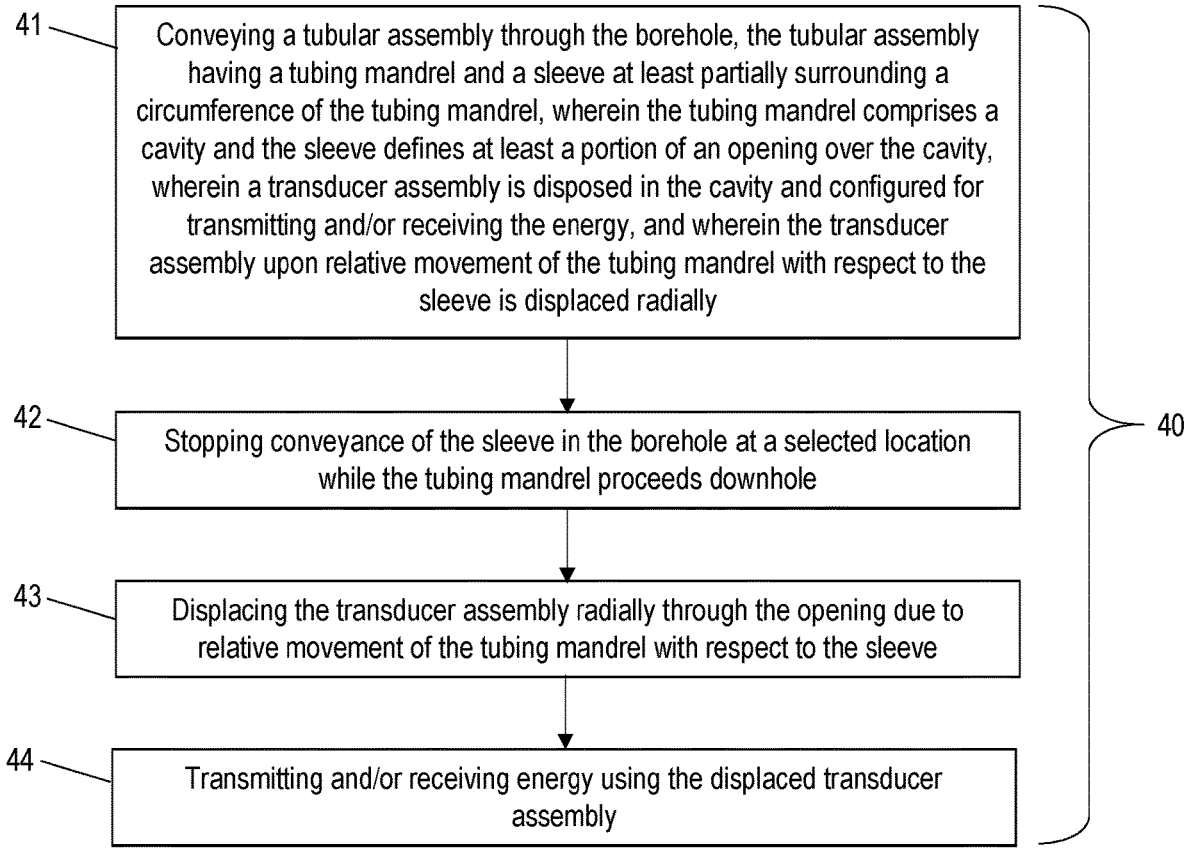
FIG. 4 is a flow chart for a method for transmitting and/or receiving energy in a borehole penetrating a subsurface formation.

FIG. 4 is a flow chart for a method 40 for transmitting and/or receiving energy in a borehole penetrating a subsurface formation. Block 41 calls for conveying a tubular assembly through the borehole, the tubular assembly having a tubing mandrel and a sleeve at least partially surrounding a circumference of the tubing mandrel, wherein the tubing mandrel comprises a cavity and the sleeve defines at least a portion of an opening over the cavity, wherein a transducer assembly is disposed in the cavity and configured for transmitting and/or receiving the energy, and wherein the transducer assembly upon relative movement of the tubing mandrel with respect to the sleeve is displaced radially. In one or more embodiments, the transducer assembly is displaced radially outward to make contact with a casing lining the borehole. In one or more embodiments, the transducer assembly upon being radially displaced outward sits upon an outer surface of the tubing mandrel.

Block 42 calls for stopping conveyance of the sleeve in the borehole at a selected location while the tubing mandrel proceeds downhole. The stopping of the conveyance of the sleeve may be performed by a locating collet disposed on the sleeve. The locating collet can engage a feature on a casing lining the borehole. In one or more embodiments, the feature can be a groove and the locating collet can include one or more fingers that can interlock with the groove to stop axial movement of the sleeve.

Block 43 calls for displacing the transducer assembly radially through the opening due to relative movement of the tubing mandrel with respect to the sleeve. In one or more embodiments, the cavity includes a first ramp edge at an uphole end of the cavity and/or the transducer assembly includes a second ramp edge at an uphole end of transducer assembly in order for the transducer assembly to be displaced radially due to the relative movement of the tubing mandrel with respect to the sleeve. With axial movement of the sleeve stopped, but with the tubing mandrel still moving in the downhole direction, the uphole edge of the transducer assembly will be forced up the uphole edge of the cavity by the first ramp edge and/or the second ramp edge and be disposed on an outside surface of the tubing mandrel.

Block 44 calls for transmitting and/or receiving energy using the displaced transducer assembly. The transmitted energy can be received by an exterior transducer that is exterior to a casing lining the borehole and used as power for operation of a sensor also disposed exterior to the casing. In one or more embodiments, the energy is acoustic energy although in other embodiments the energy can have other forms such as electromagnetic energy. The received energy can include a signal from the sensor that has measurement data. The measurement data can be transmitted to a surface signal receiver by downhole electronics, which may be disposed between the tubing mandrel and the sleeve. An electrical cable may be used to convey the signal to the surface although other telemetry systems may also be used.

The method 40 may further include wherein stopping conveyance of the sleeve includes using a locating collet disposed on the sleeve, the locating collet being configured to engage a feature on a casing lining the borehole in order to stop the conveyance.

The method 40 may further include stopping conveyance of the tubing mandrel by engaging the tubing mandrel with a tubing hanger at a defined location.

The method 40 may further include sensing a property value using a sensor disposed exterior to a casing lining the borehole and transmitting a signal comprising the property value from an exterior transducer external to the casing and in communication with the sensor to the transducer assembly that is extended. The method 40 may further include transmitting acoustic energy from the transducer assembly to the exterior transducer to power the sensor.

In support of the teachings herein, various analysis components may be used, including a digital and/or an analog system. For example, the downhole electronics 16 and/or the signal receiver/processing system 17 may include digital and/or analog systems. The system may have components such as a processor, storage media, memory, input, output, communications link (wired, wireless, optical or other), user interfaces (e.g., a display or printer), software programs, signal processors (digital or analog) and other such components (such as resistors, capacitors, inductors and others) to provide for operation and analyses of the apparatus and methods disclosed herein in any of several manners well-appreciated in the art. It is considered that these teachings may be, but need not be, implemented in conjunction with a set of computer executable instructions stored on a non-transitory computer readable medium, including memory (ROMs, RAMs), optical (CD-ROMs), or magnetic (disks, hard drives), or any other type that when executed causes a computer to implement the method of the present invention. These instructions may provide for equipment operation, control, data collection and analysis and other functions deemed relevant by a system designer, owner, user or other such personnel, in addition to the functions described in this disclosure. Further, various other components may be included and called upon for providing for aspects of the teachings herein. For example, a power supply, magnet, electromagnet, sensor, electrode, transmitter, receiver, transceiver, antenna, controller, optical unit or components, electrical unit or electromechanical unit may be included in support of the various aspects discussed herein or in support of other functions beyond this disclosure.

Set forth below are some embodiments of the foregoing disclosure:

Embodiment 1: An apparatus for transmitting and/or receiving energy in a borehole penetrating a subsurface formation, the apparatus comprising: a tubular assembly comprising a tubing mandrel and a sleeve at least partially surrounding a circumference of the tubing mandrel, wherein the tubing mandrel comprises a cavity and the sleeve defines at least a portion of an opening over the cavity; and a transducer assembly disposed in the cavity and configured for transmitting and/or receiving the energy, wherein the transducer assembly upon relative movement of the tubing mandrel with respect to the sleeve is displaced radially.

Embodiment 2: The apparatus according to any previous embodiment, wherein the transducer assembly is displaced radially outward.

Embodiment 3: The apparatus according to any previous embodiment, wherein the transducer assembly upon being radially displaced outward makes contact with a casing lining the borehole.

Embodiment 4: The apparatus according to any previous embodiment, wherein the cavity comprises a first ramp edge at an uphole end of the cavity and/or the transducer assembly comprises a second ramp edge at an uphole end of the transducer assembly in order for the transducer assembly to be displaced radially due to the relative movement of the tubing mandrel with respect to the sleeve.

Embodiment 5: The apparatus according to any previous embodiment, further comprising a releasable securing device securing the sleeve to the tubing mandrel.

Embodiment 6: The apparatus according to any previous embodiment, wherein the releasable securing device comprises a shear screw.

Embodiment 7: The apparatus according to any previous embodiment, further comprising a locating collet disposed on the sleeve and configured to interlock with a casing lining the borehole at a specified location in order to stop downhole movement of the sleeve.

Embodiment 8: The apparatus according to any previous embodiment, wherein the locating collet comprises a finger being urged outward from the locating collet.

Embodiment 9: The apparatus according to any previous embodiment, wherein the finger is configured to interlock with a groove in the casing.

Embodiment 10: The apparatus according to any previous embodiment, further comprising a sensor disposed exterior to a casing lining the borehole and an exterior transducer disposed exterior to the casing and in communication with the sensor and with a transducer in the transducer assembly after that transducer assembly displaces radially from the cavity.

Embodiment 11: The apparatus according to any previous embodiment, wherein the sensor is at least one of a pressure sensor and a temperature sensor.

Embodiment 12: The apparatus according to any previous embodiment, further comprising downhole electronics disposed in an annulus between the tubing mandrel and the sleeve and configured to transmit sensor data received by the transducer assembly to a surface receiver system.

Embodiment 13: The apparatus according to any previous embodiment, wherein the downhole electronics are further configured to transmit energy to the transducer assembly for transmission to the exterior transducer.

Embodiment 14: The apparatus according to any previous embodiment, wherein the transducer assembly comprises a transducer disposed on a carrier.

Embodiment 15: The apparatus according to any previous embodiment, wherein the carrier comprises the second ramp edge.

Embodiment 16: The apparatus according to any previous embodiment, wherein the transducer is an acoustic transducer.

Embodiment 17: The apparatus according to any previous embodiment, wherein the acoustic transducer comprises a compliant pad configured to seal against a casing lining the borehole.

Embodiment 18: A method for transmitting and/or receiving energy in a borehole penetrating a subsurface formation, the method comprising: conveying a tubular assembly through the borehole, the tubular assembly comprising a tubing mandrel and a sleeve at least partially surrounding a circumference of the tubing mandrel, wherein the tubing mandrel comprises a cavity and the sleeve defines at least a portion of an opening over the cavity, wherein a transducer assembly is disposed in the cavity and configured for transmitting and/or receiving the energy, and wherein the transducer assembly upon relative movement of the tubing mandrel with respect to the sleeve is displaced radially; stopping conveyance of the sleeve in the borehole at a selected location while the tubing mandrel proceeds downhole; displacing the transducer assembly radially through the opening due to relative movement of the tubing mandrel with respect to the sleeve; and transmitting and/or receiving energy using the displaced transducer assembly.

Embodiment 19: The method according to any previous embodiment, wherein stopping conveyance of the sleeve comprises using a locating collet disposed on the sleeve, the locating collet being configured to engage a feature on a casing lining the borehole in order to stop the conveyance.

Embodiment 20: The method according to any previous embodiment, further comprising: sensing a property value using a sensor disposed exterior to a casing lining the borehole; transmitting a signal comprising the property value from an exterior transducer external to the casing and in communication with the sensor to the transducer assembly that is displaced radially; and transmitting acoustic energy from the transducer assembly to the exterior transducer to power the sensor.

Elements of the embodiments have been introduced with either the articles "a" or "an." The articles are intended to mean that there are one or more of the elements. The terms "including" and "having" and the like are intended to be inclusive such that there may be additional elements other than the elements listed. The conjunction "or" when used with a list of at least two terms is intended to mean any term or combination of terms. The term "configured" relates one or more structural limitations of a device that are required for the device to perform the function or operation for which the device is configured. The terms "first," "second" and the like are used to differentiate elements and are not intended to denote a particular order.

The flow diagram depicted herein is just an example. There may be many variations to this diagram or the steps (or operations) described therein without departing from the scope of the invention. For example, operations may be performed in another order or other operations may be performed at certain points without changing the specific disclosed sequence of operations with respect to each other. All of these variations are considered a part of the claimed invention.

The disclosure illustratively disclosed herein may be practiced in the absence of any element which is not specifically disclosed herein.

While one or more embodiments have been shown and described, modifications and substitutions may be made thereto without departing from the scope of the invention. Accordingly, it is to be understood that the present invention has been described by way of illustrations and not limitation.

It will be recognized that the various components or technologies may provide certain necessary or beneficial functionality or features. Accordingly, these functions and features as may be needed in support of the appended claims and variations thereof, are recognized as being inherently included as a part of the teachings herein and a part of the invention disclosed.

While the invention has been described with reference to exemplary embodiments, it will be understood that various changes may be made and equivalents may be substituted for elements thereof without departing from the scope of the invention. In addition, many modifications will be appreciated to adapt a particular instrument, situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. An apparatus for transmitting and/or receiving energy in a borehole penetrating a subsurface formation, the apparatus comprising:

a tubular assembly comprising a tubing mandrel and a sleeve at least partially surrounding a circumference of the tubing mandrel, wherein the tubing mandrel comprises a cavity and the sleeve defines at least a portion of an opening over the cavity; and a transducer assembly disposed in the cavity and configured for transmitting and/or receiving the energy, wherein the transducer assembly upon relative movement of the tubing mandrel with respect to the sleeve is displaced radially outward such that at least a portion of the transducer assembly extends outside of the sleeve.

2. The apparatus according to claim 1, wherein the transducer assembly upon being radially displaced outward makes contact with a casing lining the borehole.

3. The apparatus according to claim 1, wherein the cavity comprises a first ramp edge at an uphole end of the cavity and/or the transducer assembly comprises a second ramp edge at an uphole end of the transducer assembly in order for the transducer assembly to be displaced radially due to the relative movement of the tubing mandrel with respect to the sleeve.

4. The apparatus according to claim 3, wherein the transducer assembly comprises a transducer disposed on a carrier.

5. The apparatus according to claim 4, wherein the carrier comprises the second ramp edge.

6. The apparatus according to claim 4, wherein the transducer is an acoustic transducer.

7. The apparatus according to claim 6, wherein the acoustic transducer comprises a compliant pad configured to seal against a casing lining the borehole.

8. The apparatus according to claim 1, further comprising a releasable securing device securing the sleeve to the tubing mandrel.

9. The apparatus according to claim 8, wherein the releasable securing device comprises a shear screw.

10. The apparatus according to claim 1, further comprising a locating collet disposed on the sleeve and configured to interlock with a casing lining the borehole at a specified location in order to stop downhole movement of the sleeve.

11. The apparatus according to claim 10, wherein the locating collet comprises a finger being urged outward from the locating collet.

12. The apparatus according to claim 11, wherein the finger is configured to interlock with a groove in the casing.

13. The apparatus according to claim 1, further comprising a sensor disposed exterior to a casing lining the borehole and an exterior transducer disposed exterior to the casing and in communication with the sensor and with a transducer in the transducer assembly after that transducer assembly displaces radially from the cavity.

14. The apparatus according to claim 13, wherein the sensor is at least one of a pressure sensor and a temperature sensor.

15. The apparatus according to claim 13, further comprising downhole transmitter electronics disposed in an annulus between the tubing mandrel and the sleeve and configured to transmit sensor data received by the transducer assembly to a surface receiver system.

16. The apparatus according to claim 15, wherein the downhole transmitter electronics are further configured to transmit energy to the transducer assembly for transmission to the exterior transducer.

17. A method for transmitting and/or receiving energy in a borehole penetrating a subsurface formation, the method comprising:

conveying a tubular assembly through the borehole, the tubular assembly comprising a tubing mandrel and a sleeve at least partially surrounding a circumference of the tubing mandrel, wherein the tubing mandrel comprises a cavity and the sleeve defines at least a portion of an opening over the cavity, wherein a transducer assembly is disposed in the cavity and configured for transmitting and/or receiving the energy, and wherein the transducer assembly upon relative movement of the tubing mandrel with respect to the sleeve is displaced radially outward such that at least a portion of the transducer assembly extends outside of the sleeve:

stopping a conveyance of the sleeve in the borehole at a selected location while the tubing mandrel proceeds downhole;

said displacing the transducer assembly radially through the opening due to the relative movement of the tubing mandrel with respect to the sleeve; and transmitting and/or receiving the energy using the displaced transducer assembly.

18. The method according to claim 17, wherein said stopping the conveyance of the sleeve comprises using a locating collet disposed on the sleeve, the locating collet being configured to engage a feature on a casing lining the borehole in order to stop the conveyance.

19. The method according to claim 17, further comprising:

sensing a property value using a sensor disposed exterior to a casing lining the borehole;

transmitting a signal comprising the property value from an exterior transducer external to the casing and in communication with the sensor to the transducer assembly that is displaced radially; and transmitting acoustic energy from the transducer assembly to the exterior transducer to power the sensor.

* * * * *